US012446743B2

(12) United States Patent
Koch et al.

(10) Patent No.: US 12,446,743 B2
(45) Date of Patent: Oct. 21, 2025

(54) CLEANER HEAD FOR A VACUUM CLEANING APPLIANCE

(71) Applicant: Dyson Technology Limited, Wiltshire (GB)

(72) Inventors: Stefan Koch, Dorset (GB); Andrew James Bower, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 354 days.

(21) Appl. No.: 17/767,366

(22) PCT Filed: Sep. 22, 2020

(86) PCT No.: PCT/GB2020/052286

§ 371 (c)(1),
(2) Date: Apr. 7, 2022

(87) PCT Pub. No.: WO2021/069861

PCT Pub. Date: Apr. 15, 2021

(65) Prior Publication Data

US 2022/0395153 A1 Dec. 15, 2022

(30) Foreign Application Priority Data

Oct. 10, 2019 (GB) ..... 1914653

(51) Int. Cl.
*A47L 9/04* (2006.01)
*A46B 13/00* (2006.01)
(Continued)

(52) U.S. Cl.
CPC ..... *A47L 9/0477* (2013.01); *A46B 13/006* (2013.01); *A46B 13/02* (2013.01); *A46D 1/0207* (2013.01); *A46B 2200/3033* (2013.01)

(58) Field of Classification Search
CPC ..... A47L 9/0477; A47L 11/18; A47L 11/19; A47L 11/4041; A46B 13/006
(Continued)

(56) References Cited

U.S. PATENT DOCUMENTS 2,230,722 A * 2/1941 Lang ..... A47L 9/0411 15/383
2,459,007 A * 1/1949 Taylor ..... A47L 9/0477 D32/33
(Continued)

FOREIGN PATENT DOCUMENTS

AU 2015101777 A4 1/2016
AU 2016211450 A1 * 9/2017 ..... A47L 5/30
(Continued)

OTHER PUBLICATIONS

Office Action received for Japanese Patent Application No. 2022-521552, mailed on Mar. 22, 2023, 10 pages (6 pages of English Translation and 4 pages of Original Document).
(Continued)

*Primary Examiner* — Marc Carlson
(74) *Attorney, Agent, or Firm* — Tucker Ellis LLP

(57) ABSTRACT

A cleaner head for a vacuum cleaning appliance, the cleaner head including a main body supporting an agitator. The agitator includes a rotatable cylindrical body that bears an elongate agitator formation for engaging a floor surface as the cylindrical body rotates. The elongate agitator formation includes a first agitator row extending around the cylindrical body from a respective first edge L of the cylindrical body towards its centre C in a first helical direction and a second agitator row extending around the cylindrical body from a respective second edge R of the cylindrical body towards its centre C in a second helical direction that is counter to the first helical direction, wherein the first agitator row includes agitators of a first material and wherein the second agitator
(Continued)

row includes agitators of a second material that is different to the first material.

12 Claims, 6 Drawing Sheets

(51) Int. Cl.
*A46B 13/02* (2006.01)
*A46D 1/00* (2006.01)

(58) Field of Classification Search
USPC ..... 15/383
See application file for complete search history.

(56) References Cited

U.S. PATENT DOCUMENTS

| | | | | |
|---|---|---|---|---|
| 4,349,936 | A | 9/1982 | Lorson et al. | |
| 5,452,490 | A | 9/1995 | Brundula et al. | |
| 6,574,823 | B1 | 6/2003 | Stegens | |
| 6,760,952 | B1 | 7/2004 | Stegens | |
| 6,779,231 | B1 | 8/2004 | Stegens et al. | |
| 12,082,763 | B2 * | 9/2024 | Karlsson | A47L 9/0477 |
| 2006/0053584 | A1 | 3/2006 | Dever | |
| 2010/0306956 | A1 * | 12/2010 | Follows | A47L 9/0477 15/363 |
| 2010/0306957 | A1 * | 12/2010 | Follows | A46B 13/02 15/363 |
| 2010/0306959 | A1 | 12/2010 | Follows et al. | |
| 2012/0017936 | A1 | 1/2012 | Dant et al. | |
| 2015/0033498 | A1 | 2/2015 | McVey | |
| 2015/0230676 | A1 * | 8/2015 | Eriksson | A47L 9/02 15/383 |
| 2015/0342430 | A1 * | 12/2015 | Kasper | A46B 13/006 15/183 |
| 2016/0073841 | A1 | 3/2016 | Eriksson | |
| 2016/0183746 | A1 | 6/2016 | Krebs | |
| 2016/0183749 | A1 | 6/2016 | Isley et al. | |
| 2016/0345792 | A1 * | 12/2016 | Herron | A47L 9/0477 |
| 2017/0172363 | A1 | 6/2017 | Eriksson et al. | |
| 2017/0280957 | A1 * | 10/2017 | Jeong | A47L 9/0411 |
| 2017/0340180 | A1 | 11/2017 | Isley et al. | |
| 2018/0070785 | A1 * | 3/2018 | Udy | A47L 7/0066 |
| 2019/0142232 | A1 * | 5/2019 | McRorie | A47L 11/34 15/347 |
| 2019/0307302 | A1 * | 10/2019 | Zheng | A47L 9/0477 |
| 2020/0275812 | A1 * | 9/2020 | Burbank | A47L 9/0411 |
| 2021/0068600 | A1 * | 3/2021 | Xing | A46B 9/005 |
| 2022/0053984 | A1 * | 2/2022 | Karlsson | A47L 11/4041 |
| 2022/0354323 | A1 * | 11/2022 | Schappler | B32B 25/10 |
| 2024/0172906 | A1 * | 5/2024 | Deschenes | A47L 9/0411 |

FOREIGN PATENT DOCUMENTS

| | | | | |
|---|---|---|---|---|
| CA | 2169812 | A1 * | 8/1996 | |
| CA | 2615181 | A1 * | 6/2008 | A46B 13/001 |
| CA | 2975385 | A1 | 8/2016 | |
| CA | 3073677 | A1 * | 2/2019 | A47L 5/30 |
| CN | 203169091 | U | 9/2013 | |
| CN | 105395135 | A * | 3/2016 | A47L 5/22 |
| CN | 107997678 | A | 5/2018 | |
| CN | 108354518 | A | 8/2018 | |
| CN | 108903798 | A * | 11/2018 | A47L 9/0411 |
| CN | 208659190 | U * | 3/2019 | A46B 13/005 |
| CN | 109715022 | A | 5/2019 | |
| CN | 110477803 | A * | 11/2019 | A47L 9/0477 |
| CN | 110840340 | A * | 2/2020 | A47L 11/24 |
| CN | 111281267 | A * | 6/2020 | A47L 9/04 |
| CN | 211559925 | U * | 9/2020 | |
| CN | 111728530 | A * | 10/2020 | |
| CN | 112587030 | A * | 4/2021 | A47L 9/04 |
| CN | 113287971 | A * | 8/2021 | A46B 17/06 |
| CN | 113768408 | A * | 12/2021 | A47L 11/24 |
| CN | 115299807 | A * | 11/2022 | |
| CN | 218009532 | U * | 12/2022 | A46B 13/001 |
| DE | 4412986 | A1 * | 10/1995 | A47L 9/0411 |
| DE | 102007031371 | A1 * | 1/2009 | A46B 13/006 |
| DE | 102016120859 | A1 * | 5/2018 | A47L 9/0466 |
| DE | 102017117732 | A1 * | 2/2019 | |
| DE | 102020115219 | A1 * | 12/2021 | A47L 9/0477 |
| EP | 2482692 | A1 | 8/2012 | |
| EP | 2974640 | A1 * | 1/2016 | A47L 9/0455 |
| EP | 3167785 | A1 * | 5/2017 | A47L 11/24 |
| EP | 3187083 | A1 * | 7/2017 | A47L 9/04 |
| EP | 3342323 | A2 * | 7/2018 | A46B 1/00 |
| EP | 3646756 | A1 * | 5/2020 | A46B 13/001 |
| EP | 2770893 | B1 * | 8/2023 | A46B 13/006 |
| ES | 2265471 | T3 | 2/2007 | |
| FR | 2494982 | A1 * | 6/1982 | |
| GB | 2088708 | A * | 6/1982 | A46B 9/02 |
| GB | 0391597 | A | 5/1993 | |
| GB | 2492117 | A * | 12/2012 | A46B 15/0018 |
| JP | 50-075260 | U | 7/1975 | |
| JP | 52-035184 | U | 3/1977 | |
| JP | 55-002414 | A | 1/1980 | |
| JP | S552414 | A * | 1/1980 | |
| JP | 2000-157462 | A | 6/2000 | |
| JP | 2010284527 | A | 12/2010 | |
| JP | 2014-240029 | A | 12/2014 | |
| KR | 20100088360 | A * | 8/2010 | |
| KR | 10-2018-0079071 | A | 7/2018 | |
| KR | 20200045606 | A * | 5/2020 | |
| TW | I742622 | B * | 10/2021 | |
| WO | 2016/008763 | A2 | 1/2016 | |
| WO | 2016/123345 | A1 | 8/2016 | |
| WO | WO-2020114605 | A1 * | 6/2020 | A47L 11/4041 |

OTHER PUBLICATIONS

Office Action received for Chinese Patent Application No. 202080067141.9, mailed on Nov. 18, 2022, 6 pages of Original Document Only.

Office Action received for Japanese Patent Application No. 2022-521552, mailed on Aug. 8, 2023, 9 pages (5 pages of English Translation and 4 pages of Original Document).

International Search Report and Written Opinion received for PCT Patent Application No. PCT/GB2020/052286, mailed on Nov. 26, 2020, 9 pages.

Search Report received for Great Britain Patent Application No. 1914653.9 , mailed on Mar. 27, 2020, 1 page.

* cited by examiner

CLEANER HEAD FOR A VACUUM CLEANING APPLIANCE

CROSS-REFERENCE TO PRIOR APPLICATION

This application is a § 371 National Stage Application of PCT International Application No. PCT/GB2020/052286 filed Sep. 22, 2020, which claims the priority of United Kingdom Application No. 1914653.9, filed Oct. 10, 2019, each of which are herein incorporated by reference in their entirety.

TECHNICAL FIELD

The invention relates generally to vacuum cleaners, and particularly to a cleaner head or floor tool which forms part of a vacuum cleaner. The invention is concerned specifically with rotationally-driven agitators used in such cleaner heads, whether or not the cleaner head is permanently or removably fixed on a respective vacuum cleaner. The type of vacuum cleaner is immaterial to the invention, and so the invention may relate to so-called bagged or bagless vacuum cleaners.

BACKGROUND

A vacuum cleaning appliance or, more simply, 'vacuum cleaner', typically comprises a main body equipped with a suction source and a dust separator, wherein a cleaner head is connected to that dust separator usually by a separable coupling. The cleaner head has a suction opening with which it engages a surface to be cleaned and through which dirt-laden air is drawn into the vacuum cleaner towards the dust separator. The cleaner head performs a crucial role in the effectiveness of a vacuum cleaner in removing dirt from a surface, whether that surface is a hard floor covering such as wood or stone, or a soft floor covering such as carpet. Therefore, much effort is made by vacuum cleaner manufacturers to optimise cleaner head design to improve performance.

Some cleaner heads are passive devices which rely on stationary elements such as so-called 'active edges' and bristle strips to dislodge dirt from floor coverings. These types of cleaner heads are relatively simple but generally their effectiveness at removing dirt from surfaces is limited. Often, they are recommended mainly for use on hard surfaces.

Conventionally, the most effective cleaner heads incorporate some kind of powered brush bar or agitator. Examples are known in which the agitator is driven by a turbine which is actuated by the airflow through the cleaner head. Other known arrangements involve the use of an electric motor that is arranged to drive the agitator. In these known arrangements, it is usual for the motor to be coupled to the agitator by a suitable drive linkage such as a belt or gear mechanism, although it is also known for the motor to be housed within the agitator which F In both examples, the powered agitator serves to wipe and beat the floor surface in order to improve the capability of the cleaner head to remove dirt from that surface. A common configuration is for the agitator to carry an array of bristles that extend radially outward from the surface of the agitator. The bristles are typically relatively stiff so that they engage the floor surface aggressively as the agitator rotates, thereby serving as a means to scrape and strike the floor surface to loosen embedded particles. Other strips of material such as rubber and carbon fibre filaments may be used to provide complementary characteristics to the agitator. By way of example, U.S. Pat. No. 8,782,851 B2 describes an agitator that may be provided with a combination of relatively stiff bristles, carbon filaments and rubber strips.

One particular design challenge relates to the use of cleaner heads with cordless vacuum cleaners. The effectiveness of the cleaner head is a key factor in pickup performance together with the suction power generated by the vacuum motor. Although pickup performance can generally be improved by using high power settings, this compromises battery run time severely and is undesirable from the perspective of the user. Therefore a great deal of attention is given to how to improve or at least maintain desirable pickup performance of a cleaner head whilst reducing energy consumption of the vacuum cleaner.

It is against this background that the invention has been devised.

SUMMARY OF THE INVENTION

According to a first aspect of the invention, there is provided a cleaner head (10) for a vacuum cleaning appliance, the cleaner head (10) comprising: a main body (12) supporting an agitator (36), the agitator (36) comprising a rotatable cylindrical body (42) that bears an elongate agitator formation (44) for engaging a surface, for example a floor surface, as the cylindrical body (42) rotates, wherein the elongate agitator formation (44) includes: a first agitator row (46) that extends around the cylindrical body (42) in a direction from a respective first edge (L) of the cylindrical body (42) towards a respective second edge (R) in a first helical direction, the first agitator row (46) extending from a position proximate the first edge (L) towards or beyond a centre (C) of the cylindrical body, and a second agitator row (47) that extends around the cylindrical body (42) in a direction from the second edge (R) of the cylindrical body (42) towards the first edge (L) in a second helical direction that is counter to the first helical direction, the second agitator row (47) extending from a position proximate the second edge (R) towards or beyond the centre (C) of the cylindrical body, the first (46) and second (47) agitator rows extend axially along the cylindrical body (42) such that they do not overlap with one another, wherein the first agitator row (46) comprises agitators of a first material and wherein the second agitator row (47) comprises agitators of a second material that is different to the first material.

By not overlapping, it is meant that the agitator rows do not cross to occupy the same portions of the cylindrical body, ensuring a single point of contact is achieved either side of the cylindrical body between the floor surface and each of the first and second materials regardless of the rotational position of the cylindrical body. This arrangement helps maintain a regular distribution of the friction created between the agitator and the floor surface during rotation of the agitator.

As used herein the term "proximate" shall be taken to mean at or near to. In this embodiment "near to" may mean within 10 mm of the edge, for example from 1, or 2, or 4, or 6, 8 or 10 mm from the respective edge of the cylindrical body. In a most preferred embodiment the agitator rows extend from the edge.

Preferably, the first agitator row and the second agitator row meet to define an apex. This arrangement serves to guide the airflow through the cleaner head, improving the effectiveness of the cleaner head.

Preferably, the apex is located at approximately the centre of the agitator. Positioning the apex at the centre of the agitator further improves the effectiveness of the cleaner head since the pick-up of dirt and dust particles from the floor surface over time is more uniform across the length of the agitator. The apex may however be positioned closer to one edge than the other edge.

Preferably, in use the apex points in the direction of rotation of the agitator. Alternatively in use the apex may point away from the direction of rotation of the agitator.

Alternatively, instead of meeting to form an apex an axially inner end of the first agitator row and an axially inner end of the second agitator row are angularly offset from one another, defining a radial gap therebetween.

Preferably, the first and second agitator rows extend from the respective first and second edges of the cylindrical body at substantially equal angular positions.

Preferably, the stiffness of the first material is greater than the stiffness of the second material. Stiff agitators can dislodge stubborn dirt from carpeted floor surfaces, so that the dirt can be more easily entrained in the airflow through the cleaner head. Whereas, relatively more deformable agitators act to sweep dirt and dust, particularly fine dust, from hard floor surfaces. This arrangement improves the versatility of the cleaner head, as its effectiveness for picking up dirt and dust particles is maintained across different surface types. Preferably, the first material is nylon and the second material is carbon fibre. Other suitable agitators may comprise strips formed from, felt, foam, rubber or plastics material.

Preferably, the first and second agitator rows circumferentially extend around the cylindrical body once. This arrangement ensures that there will be only a single contact point between each row and the floor surface at any time throughout the rotation of the agitator.

Preferably, the elongate agitator formation comprises a third agitator row (48) that extends around the cylindrical body (42) in a direction from the first edge (L) of the cylindrical body (42) towards the second edge (R) in the first helical direction, the third agitator row (48) extending from a position proximate the first edge (L) towards or beyond the centre (C) and comprising agitators of the second material, and a fourth agitator row (49) that extends around the cylindrical body (42) in a direction from the second edge (R) of the cylindrical body (42) toward the first edge (L) in the second helical direction, the fourth agitator row (49) extending from a position proximate the second edge (R) towards or beyond the centre (C) and comprises agitators of the first material, the third (48) and fourth (49) agitator rows extend axially along the cylindrical body (42) such that they do not overlap with one another.

Alternating agitator rows made of the first and second materials on each side of the cylindrical body ensures that the loading applied to the agitator is balanced, as there is no change in the overall friction created between the agitator and the floor surface during rotation of the agitator.

Preferably, in an embodiment with four agitator rows, each row circumferentially extends around the cylindrical body for half a rotation, or 180 degrees. This arrangement ensures that there will be only a single contact point between each row and the floor surface at any time throughout the rotation of the agitator.

Preferably, the third and fourth agitator rows meet to define an apex.

Preferably, the apex is located at approximately the centre of the agitator. Alternatively the apex may be position closer to one edge than the other edge.

Alternatively, an axially inner end of the third agitator row and an axially inner end of the fourth agitator row are angularly offset from one another, defining a radial gap therebetween.

Preferably, the elongate agitator formation is configured such that, during use, a single point of contact is formed between the floor surface and each of the first and second materials during rotation of the cylindrical body.

According to a second aspect of the invention, there is provided a vacuum cleaning appliance comprising the cleaner head according to the previous aspect.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

The above and other aspects of the invention will now be described, by way of example only, with reference to the accompanying drawings, in which.

Figure 1:
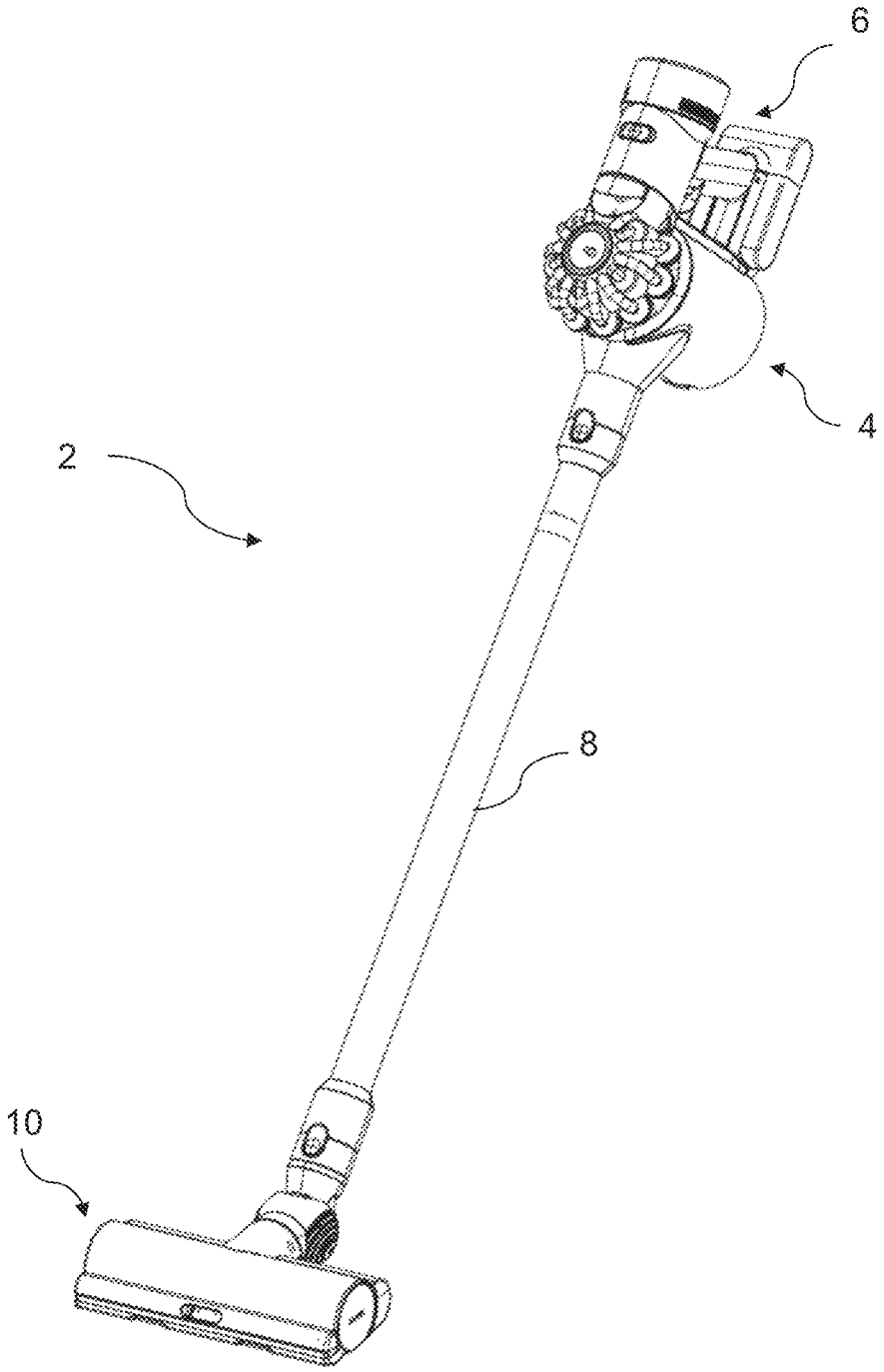
FIG. 1 is a front perspective view of a vacuum cleaner comprising a cleaner head in accordance with an embodiment of the invention.

In the drawings, like features are denoted by like reference signs.

SPECIFIC DESCRIPTION

A specific embodiment of the invention will now be described in which numerous features will be discussed in detail in order to provide a thorough understanding of the inventive concept as defined in the appended claims. However, it will be apparent to the skilled person that the invention may be put in to effect without the specific details and that, in some instances, well known methods, techniques and structures have not been described in detail in order not to obscure the invention unnecessarily. Moreover, references in the following description to "left", "right" and any other terms having an implied orientation are not intended to be limiting, and refer only to the orientation of the features as shown in the accompanying drawings.

FIG. 1 shows a vacuum cleaning appliance or vacuum cleaner 2 comprising a dirt and dust separating unit 4, a motor-driven fan unit 6 and a cleaner head 10 in accordance with an embodiment of the invention. The vacuum cleaner 2 further comprises a wand 8 connecting the dirt and dust separating unit 4 and the cleaner head 10. The motor-driven fan unit 6 draws dirt-bearing air through the cleaner head 10, from a surface to be cleaned, such as a floor surface, to the dirt and dust separating unit 4, where dirt and dust particles are separated from the dirt-bearing air and the comparatively clean air is expelled from the vacuum cleaner 2. The dirt and dust separating unit 4 shown in this example is a cyclonic separating unit, but it will be understood by the skilled person that the separating unit 4 is not material to the invention and that the cyclonic separating unit could be replaced with an alternative separating unit or a combination of different separating units. Similarly, the nature of the vacuum cleaner 2 is not material to the invention. The vacuum cleaner 2 shown in FIG. 1 is a stick vacuum cleaner, but it will be understood that the cleaner head 10 disclosed herein may be used with other types of vacuum cleaners such as, for example, upright or cylinder vacuum cleaners.

Figure 2:
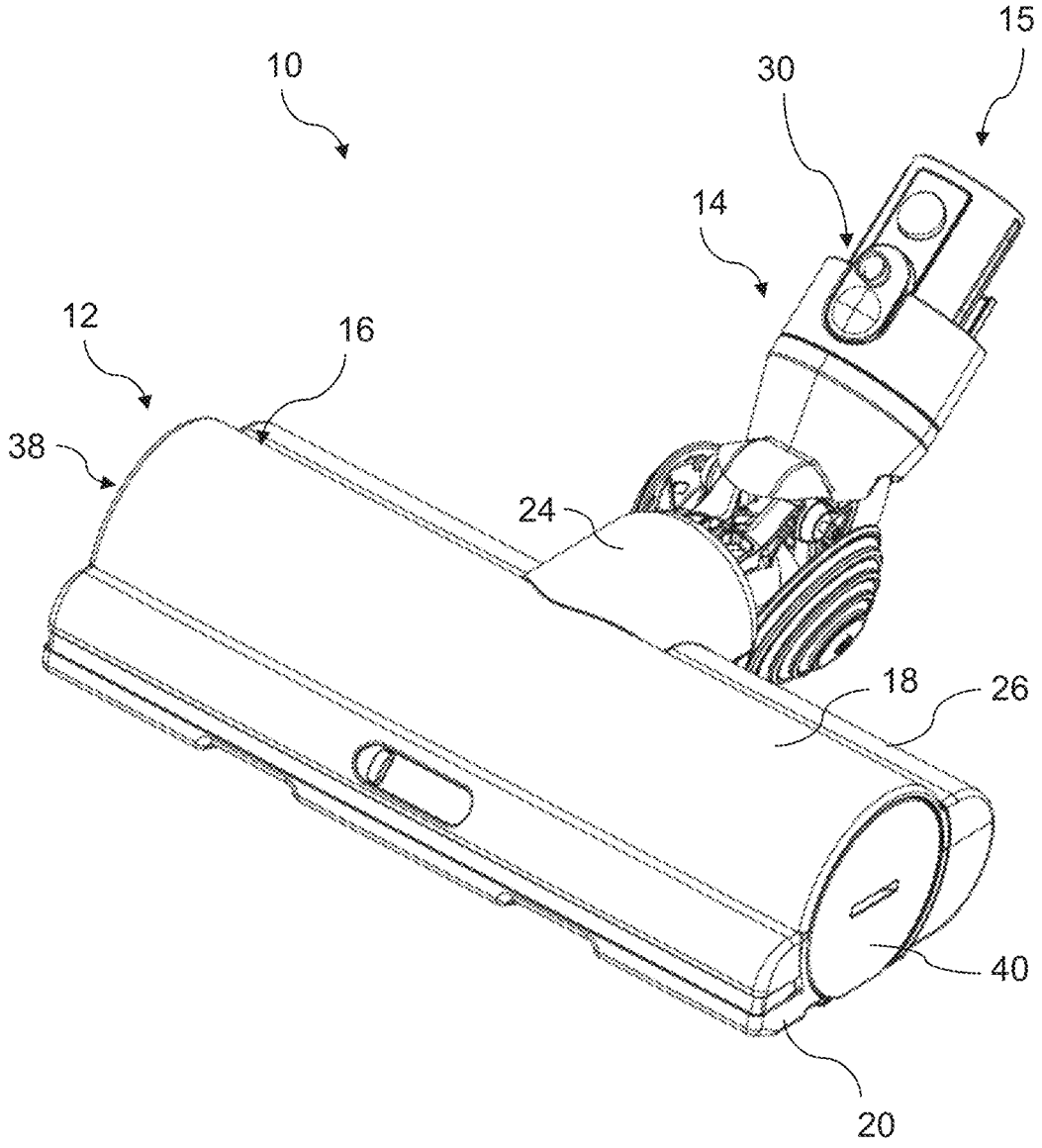
FIG. 2 is a front perspective view of the cleaner head of FIG. 1.

With reference to FIG. 2, the cleaner head 10 comprises a main body 12 having a coupling 14. The coupling 14 is configured to be removably connectable to the wand 8, a hose or other such duct of a vacuum cleaner. It will be apparent to the skilled person, however, that the invention extends to also cover cleaner heads that are configured to be permanently fixed to their respective vacuum cleaners.

The main body 12 comprises a housing 16, comprising an upper section 18 and a lower plate or sole plate 20, which defines a generally rectangular suction opening 22 through which dirt-bearing air enters the cleaner head 10 form the floor surface. The housing 16 defines a suction passage extending through the internal volume of the main body 12 from the suction opening 22 to an outlet duct 24 located at a rear section 26 of the housing 16.

The coupling 14 comprises a conduit, supported by a rolling assembly 28. The conduit comprises a forward portion connected to the outlet duct 24 and a rearward portion, pivotably connected to the forward portion. The part of the coupling 14 defining the rearward portion of the conduit comprises a fixing arrangement, generally designated by 30, for connecting a free end 15 of the coupling 14 to the wand 8. A rigid curved hose arrangement is held within and extends between the forward and rearward portions of the conduit.

Figure 3:
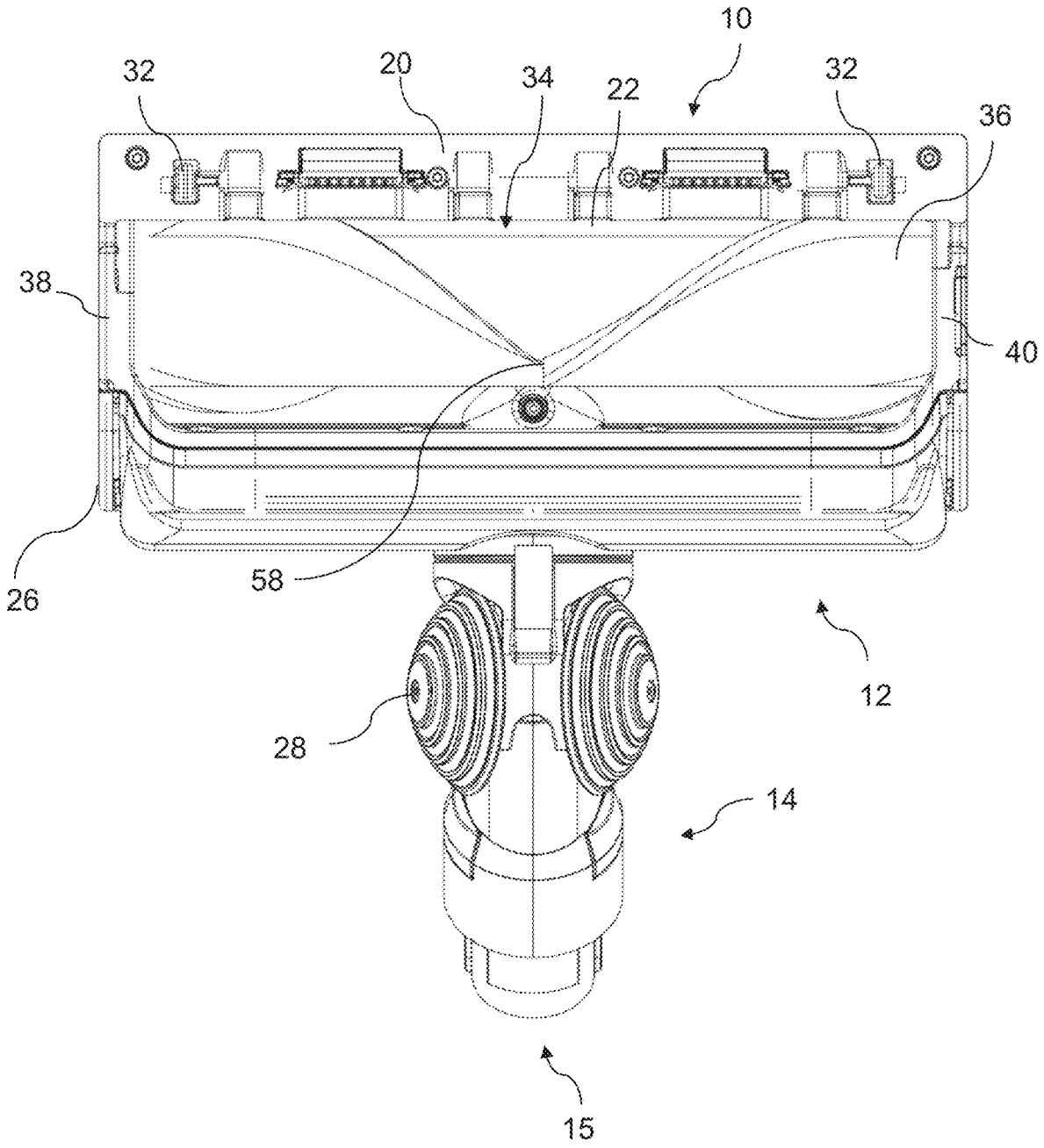
FIG. 3 is a bottom view of the cleaner head of FIG. 1.

With reference to FIG. 3, two wheels 32 are mounted within recessed portions in the bottom surface of the sole plate 20 for supporting the cleaner head 10 on the floor surface. The wheels 32 are configured to support the sole plate 20 above the floor surface when the cleaner head 10 is located on a hard floor surface, and, when the cleaner head 10 is located on a carpeted floor surface, to sink into the pile of the carpet to enable the bottom surface of the sole plate 20 to engage the fibres of the carpet. The sole plate 20 may be moveable relative to the housing 16, allowing it to ride smoothly over the carpeted floor surface during cleaning.

The internal volume of the main body 12 comprises an agitator chamber 34, which is partially defined by the upper section 18 of the housing 16. An elongate brush bar or agitator 36 is mounted within the agitator chamber 34 and rotatable about its longitudinal axis. The main body 12 further comprises two end caps 38, 40 mounted on the housing 16 at each end of the agitator chamber 34 for rotatably supporting the agitator 36 within the agitator chamber 34. Preferably, at least one of the end caps 38, 40 is detachable from the housing 16, providing access to the agitator chamber 34 so that the agitator 36 can be removed from and subsequently replaced within the agitator chamber 34. In the embodiment shown, a recessed portion is provided in the end cap 40 for facilitating its removal from the housing 16 for accessing the agitator chamber 34. The agitator 36 houses an electric motor and a drive mechanism, which connects the agitator 36 to the electric motor for driving the agitator 36 about its longitudinal axis. Such a drive arrangement is known and so will not be explained in further detail here.

Figure 4:
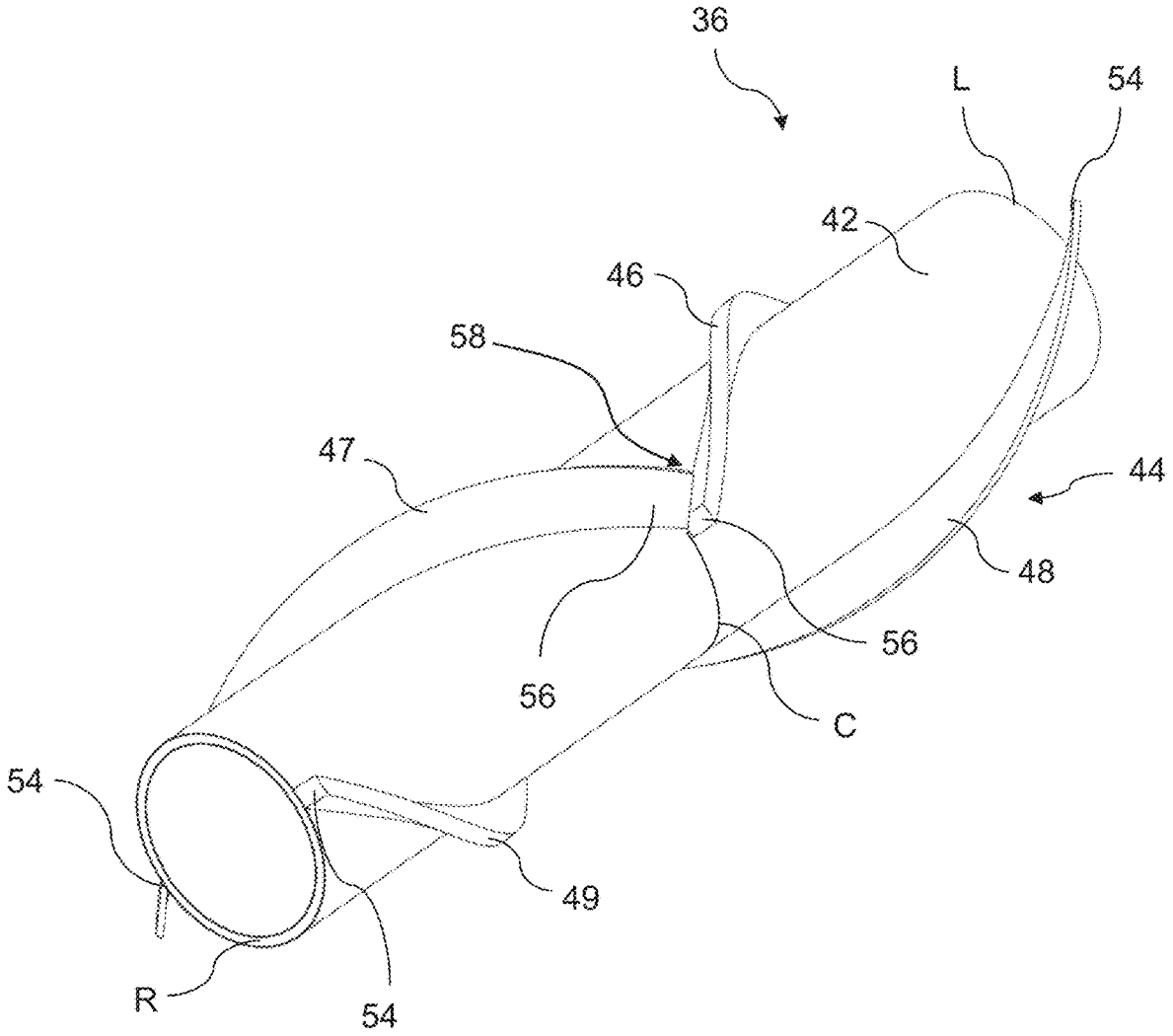
FIG. 4 is an agitator for use in the cleaner head of FIG. 1.

With reference to FIG. 4, the agitator 36 comprises a hollow, rotatable cylindrical body 42 bearing an elongate agitator formation, generally designated by 44. The elongate agitator formation 44 comprises a plurality of agitator rows extending radially outwardly from the cylindrical body 42 to protrude from the suction opening 22 when agitator 36 is mounted in the agitator chamber 34 for agitating dirt and dust particles located on the floor surface as the agitator 36 is rotated by the electric motor.

Figure 5:
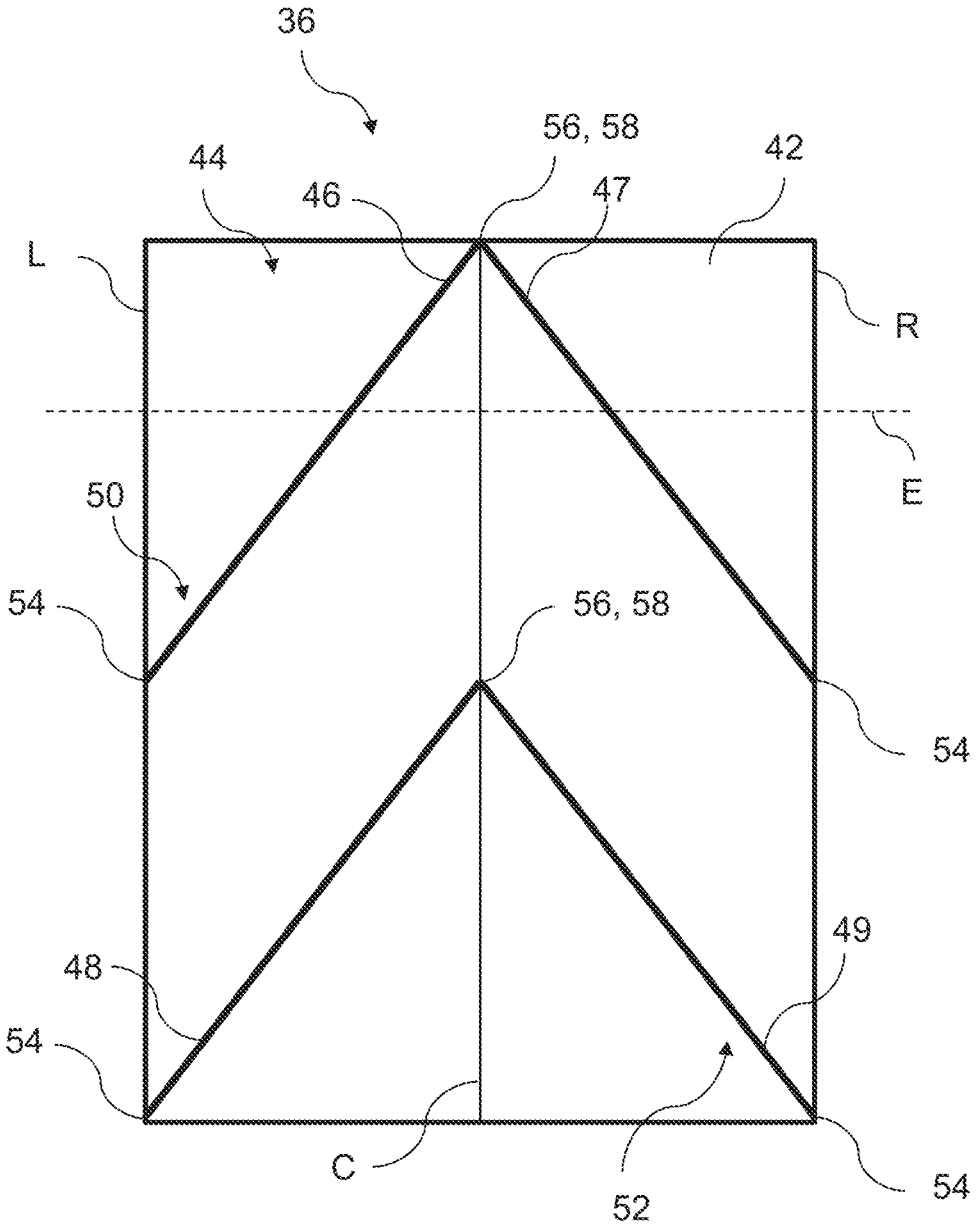
FIG. 5 is a schematic representation of the surface of the agitator as a flat surface; and, FIG. 6 is a schematic representation like that in FIG. 5 of an alternative embodiment of the agitator.

Referring also to FIG. 5, which shows a plan view of a projection of the outer surface of the cylindrical body 42 and elongate agitator formation 44, the plurality of agitator rows 46, 47, 48, 49, ordered in pairs to form two angularly spaced chevrons 50, 52. Each agitator row 46, 47, 48, 49 comprises a plurality of surface-engaging agitators, such as filaments, that are arranged substantially orthogonal to the outer radial surface of the cylindrical body 42. The agitators of each agitator row 46, 47, 48, 49 have a base fixed to the cylindrical body 42, by means of a retaining member (not shown), and are configured to rotate with the cylindrical body 42 as the electric motor drives the agitator 36. The agitators may each have tips which can flex relative to the cylindrical body 42 upon contact with the floor surface. Although the agitators forming the agitator rows 46, 47, 48, 49 are described here as comprising filaments, it should be appreciated that this is merely an example, and other materials and forms of agitator may be appropriate, such as rubber or plastics strips, felt or fluffy elements or strips, lint picker strips, tufts or rows of bristles.

In the embodiment shown, each agitator row 46, 47, 48, 49 starts from either the left- or right-side edge L, R of the cylindrical body 42 and extends partially around the cylindrical body 42 towards the centre of the agitator 36, depicted in FIGS. 4 and 5 with a line designated by C. In other embodiments, the agitator rows 46, 47, 48, 49 may extend from a region of the cylindrical body 42 adjacent the edge rather than from the edge itself. The two agitator rows 46, 47, 48, 49 forming each chevron 50, 52 extend around the agitator 36 in helical directions that are counter to one another. That is, one agitator row 46, 48 in each chevron 50, 52 extends helically around the cylindrical body 42 in a first helical direction and the other agitator row 47, 49 extends helically around the cylindrical body 42 in a second helical direction that is opposite, i.e. counter, to the first helical direction. Each agitator row 46, 47, 48, 49 circumferentially extends across half the outer radial surface of the cylindrical body 42, starting from a respective edge L, R and ending at the centre C of the cylindrical body 42. Expressed another way, each agitator row 46, 47, 48, 49 extends around the outer radial surface circumferentially for approximately 180 degrees.

The two agitator rows 46, 47, 48, 49 forming each chevron 50, 52 are arranged so that they do not overlap one another. By not overlapping, it is meant that the agitator rows 46, 47, 48, 49 do not cross to occupy the same portions of the cylindrical body 42.

The axially outer and inner ends 54, 56 of the agitator rows 46, 47, 48, 49 (hereinafter, the starts 54 and ends 56 of the agitator rows 46, 47, 48, 49) in each chevron 50, 52 are aligned so that ends 56 of the agitator rows 46, 47, 48, 49 meet in the centre of the cylindrical body 42 to form an apex 58 at the centre C of the agitator 36.

When the agitator 36, and cleaner head 10 in general, is viewed from below, as shown in FIG. 3, the apex 58 that is seen through the suction opening 22 points towards the rear section 26 of the housing 16, and specifically the outlet duct 24. This configuration generally functions to channel airflow from the suction opening 22 through the centre of the cleaner head 10 to the outlet duct 24, as opposed to a standard helical elongate agitator formation, which can act like a screw pump to move air from one side of the cleaner head 10 to the other side. This can result in an inconsistent airflow distribution through the suction opening 22, causing dust and dirt particles to accumulate in areas within the cleaner head 10. Guiding the airflow through the centre of the cleaner head 10 to the outlet duct 24, however, improves the efficiency and effectiveness of the cleaner head 10 because the pick-up of dirt and dust particles from the floor surface over time is more uniform across the entire suction opening 22. In the present embodiment, the apex 58 of each chevron 50, 52 points in the direction in which the agitator 36 is configured to rotate. However, the improvements brought about by the apexes 58 pointing towards the outlet duct 24, when the cleaner head 10 is view from below, are also realised regardless of the direction in which the agitator 36 is configured to rotate.

Furthermore, as can be best seen from FIG. 5, the agitator rows 46, 47, 48, 49 on each of the left- and right-sides L, R of the agitator 36 are arranged so that the starts 54 and ends 56 of the agitator rows 46, 47, 48, 49 on each side are diametrically opposed about the cylindrical body 42. In this way, as will be explained below in more detail, the agitator 36 always maintains points of contact between the floor surface at least two agitator rows 46, 47, 48, 49 regardless of the rotational position of the agitator 36.

To improve the operation of the agitator 36, an agitator row 46, 47, 48, 49 forming one side of a chevron 50, 52 comprises agitators made of a first material and the agitator row 46, 47, 48, 49 forming the other side of the chevron 50, 52 comprises agitators made of a second material that is different to the first material. In this embodiment, the first material is carbon fibre, while the second material is nylon. Nylon filaments are electrically insulating, while carbon fibre filaments act to discharge static electricity residing on the floor surface.

However, the skilled person will appreciate that the first and second materials could be selected based on other material properties, such as their respective stiffnesses, with a view to increasing the versatility of the cleaner head 10. For example, nylon agitators are stiffer than carbon fibre agitators, although the first and second materials should not be limited only to carbon fibre and nylon. Stiff agitators can, in use, dislodge stubborn dirt particles from carpeted floor surfaces, so that the dirt particles can be more easily entrained in the airflow through the suction opening 22. Whereas, relatively more deformable agitators act to sweep dirt and dust particles, particularly fine dust particles, from hard floor surfaces. One way in which this may be achieved is by selecting materials with dissimilar hardness characteristics, as defined on an appropriate durometer scale of hardness (e.g. Shore scale).

To further improve operation of the agitator 36, the arrangement of the agitator rows 46, 47, 48, 49 between consecutive chevrons 50, 52 differs. A first chevron 50, arbitrarily taken to be the chevron closest to the top of the depiction in FIG. 5, has an agitator row 46 comprising agitators made of a first material on the left side of the agitator 36, and an agitator row 47 comprising agitators made of a second material on the right side of the agitator 36. Conversely, in the second chevron 52, the agitator rows 48, 49 are in the opposite positions, so that the agitator row 49 comprises agitators made of the first material is on the right side of the agitator 36 and the agitator row 48 comprises agitators made of the second material is on the left side. In other words, the left-hand side of the agitator 36 has an agitator row 46 comprising agitators made of the first material, followed by an agitator row 48 comprising agitators made of the second material, while the right-hand side has an agitator row 47 comprising agitators made of the second material followed by an agitator row 49 comprising agitators made of the first material.

Put another way, the agitator 36 is considered to have a first chevron 50, comprising first and second agitator rows 46, 47 and a second chevron 52, comprising third and fourth agitator rows 48, 49, wherein the first and third agitator rows 46, 48 extend in the first helical direction from the left-side L to the centre C of the cylindrical body 42 and the second and fourth agitator rows 47, 49 extend in the second, counter helical direction from the right-side R to the centre C of the cylindrical body 42. The first and fourth agitator rows 46, 49 are made of a first material, and the second and third agitator rows 47, 48 are made of a second material that is different to the first material.

When the cleaner head 10 is in use, therefore, a single point of contact is achieved between the floor surface and each of the first and second materials at any rotational position of the cylindrical body 42. For example, consider the line designated by E in FIG. 5, which indicates a position of contact between the agitator 36 and the floor surface, in use there would be only one contact point between each of the first and second agitator rows 46, 47 and the floor surface. The same is true for any line taken across the agitator 36 parallel to its longitudinal axis. That is, there will be only a single contact point between agitators of each material and the floor surface at any time because the arrangement of the agitator rows 46, 47, 48, 49 ensures that this single point of contact is maintained throughout the rotation of the agitator 36. The loading applied to the motor is consequently balanced, because there is no change in the overall friction created between the agitator 36 and the floor surface during rotation of the agitator 36. In conventional systems, altering the contact between the floor surface and agitators leads to changes in the resistance to rotation caused by friction. This resistance fatigues the electric motor rotating the agitator 36 and/or requires greater power consumption to ensure consistent rotation of the agitator 36.

Although two chevrons 50, 52 are depicted in the embodiment shown in the figures, it is also possible that the elongate agitator formation 44 comprises only a single chevron 50. In such an embodiment, the first and second agitator rows 46, 47 are arranged to extend in counter helical directions and to continuously follow those counter helical directions. In some embodiments with a single chevron 50, the agitator rows 46, 47 are arranged to form a centrally located apex 58. However, it is not essential to have the agitator rows 46, 47 form a chevron 50, and the agitator rows 46, 47 may extend across the cylindrical body 42 in their helical direction without creating a chevron-like formation. In some embodiments, the agitator rows 46, 47 extend up to 70% across the cylindrical body 42 from their respective edge L, R.

It will be appreciated that the advantages of guiding the airflow and the single point of contact are still present in an agitator 36 only having one agitator row 46 made of a first material and another agitator row 47 made of a second material.

In other embodiments, more than four agitator rows 46, 47, 48, 49 may be incorporated into the elongate agitator formation 44. For example, six agitator rows may be used to form three chevrons, each agitator row extending around a third of the outer radial surface or circumference of the agitator 36.

Figure 6:
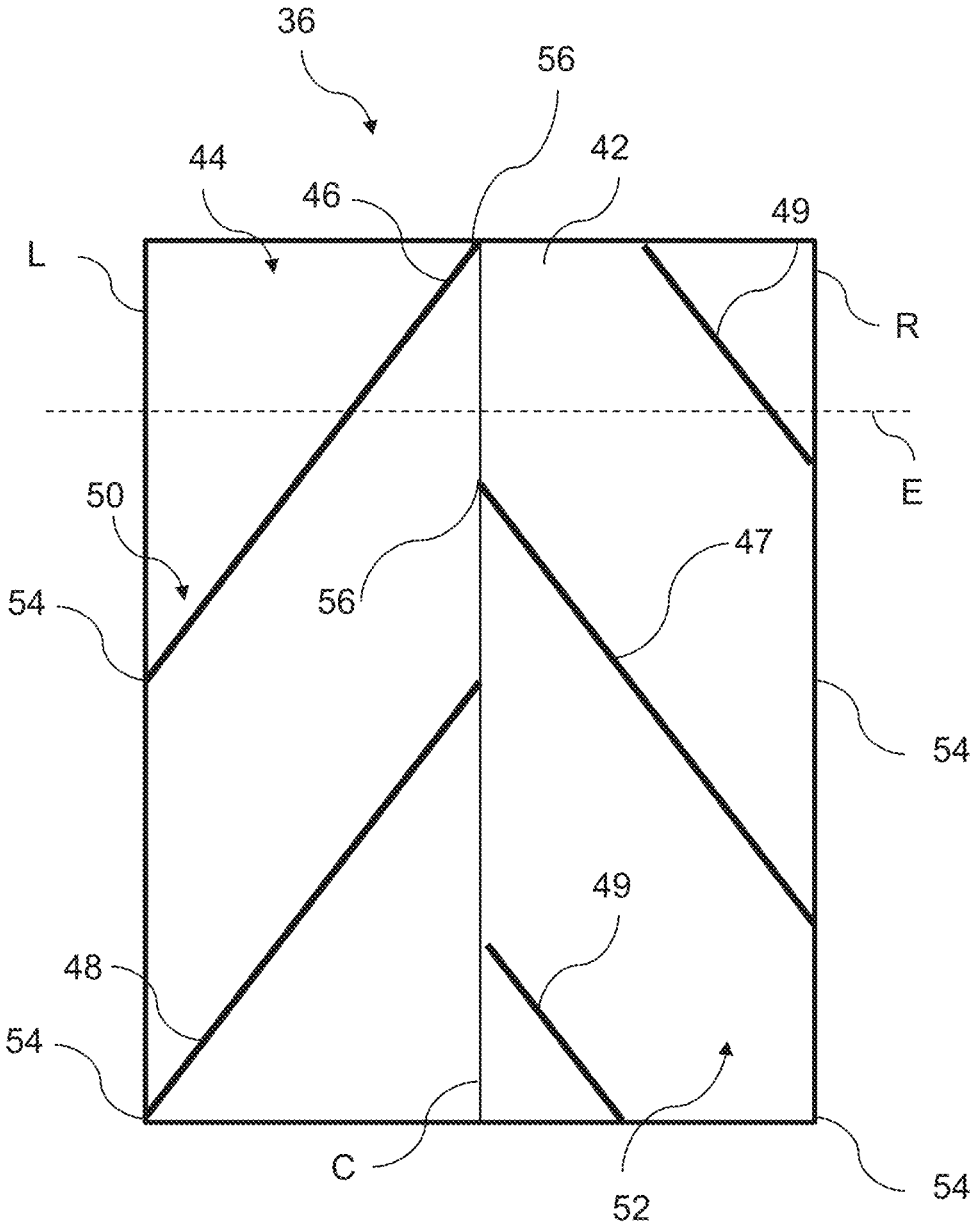

In the embodiment shown, the ends 56 of the agitator rows 46, 47, 48, 49 meet in the centre of the cylindrical body 42 to form an apex 58 at the centre C of the agitator 36. In further embodiments, the ends 56 of two agitator rows 46, 47 may be angularly offset from each other, defining a radial gap therebetween, so as not to form apex 58. Similarly, the starts 54 of the pair of agitator rows 46, 47, 48 49 forming the chevrons 50, 52 are diametrically opposed about the cylindrical body 42 in the embodiment shown. However, these starts 54 may also be angularly offset with respect to each other in other embodiments. An example of such an embodiment is shown in FIG. 6. Like FIG. 5, FIG. 6 represents the outer surface of the cylindrical body 42 which has been 'flattened out' into a two-dimensional surface so that the routing of each of the agitator rows 46, 47, 48, 49 can be more easily perceived. Here, it will be appreciated that the axially inner ends 56 of the agitator rows 46, 48 on the left hand side of the cylindrical body 42 do not meet with the axially inner ends 56 of the agitator rows 47, 49 on the right hand side of the cylindrical body 42 to form an apex, as was the case in FIG. 5. Instead, there is an angular offset between the left hand side agitator rows 46, 48 and the right hand side agitator rows 47, 49. Specifically, in this embodiment, there is an approximate 90 degree angular offset.

In some embodiments, at least one of the agitator rows 46, 47, 48, 49 comprises a strip of flexible material configured to engage the floor surface.

Although the agitators are shown to be arranged in a substantially continuous manner, they may, in some embodiments, be arranged in tufts or clumps spaced apart from one another, with each tuft comprising between 20 and 50 individual filaments or bristles.

Many modifications may be made to the above examples without departing from the scope of the present invention as defined in the accompanying claims.

The invention claimed is:

1. A cleaner head for a vacuum cleaning appliance, the cleaner head comprising:

a main body supporting an agitator, the agitator comprising a rotatable cylindrical body that bears an elongate agitator formation for engaging a surface as the cylindrical body rotates, wherein the elongate agitator formation includes:

a first agitator row that extends around the cylindrical body in a direction from a respective first edge (L) of the cylindrical body towards a respective second edge (R) in a first helical direction, the first agitator row extending from a position proximate the first edge (L) towards or beyond a centre (C) of the cylindrical body, and a second agitator row that extends around the cylindrical body in a direction from the second edge (R) of the cylindrical body towards the first edge (L) in a second helical direction that is counter to the first helical direction, the second agitator row extending from a position proximate the second edge (R) towards or beyond the centre (C) of the cylindrical body, the first and second agitator rows extending axially along the cylindrical body such that they do not overlap with one another, wherein an axially inner end of the first agitator row and an axially inner end of the second agitator row are angularly offset from one another, and wherein the first agitator row comprises agitators of a first material and wherein the second agitator row comprises agitators of a second material that is different to the first material, wherein the elongate agitator formation is configured such that during use, at every degree of rotation of the cylindrical body, the elongate agitator formation maintains only two points of contact with the floor surface, one point of contact being between the first edge (L) and the centre (C) of the cylindrical body and one point of contact being between the second edge (R) and the centre (C) of the cylindrical body, the distance between the centre (C) of the cylindrical body and the point of contact between the first edge (L) and the centre (C) of the cylindrical body always being different from the distance between the centre (C) of the cylindrical body and the point of contact between the second edge (R) and the centre (C) of the cylindrical body.

2. The cleaner head according to claim 1, wherein the axially inner end of the first agitator row and the axially inner end of the second agitator row are located at approximately the centre (C) of the agitator.

3. The cleaner head according to claim 1, wherein the axially inner end of the first agitator row is angled towards a direction of rotation of the agitator relative to an axially outer end of the first agitator row, and the axially inner end of the second agitator row is angled towards the direction of rotation relative to an axially outer end of the second agitator row.

4. The cleaner head according to claim 1, wherein the axially inner end of the first agitator row is angled away from a direction of rotation of the agitator relative to an axially outer end of the first agitator row, and the axially inner end of the second agitator row is angled away from the direction of rotation relative to an axially outer end of the second agitator row.

5. The cleaner head according to claim 1, wherein the stiffness of the first material is greater than the stiffness of the second material.

6. The cleaner head according to claim 1, wherein the first material is nylon.

7. The cleaner head according to claim 1, wherein the second material is carbon fibre.

8. The cleaner head according to claim 1, wherein the first and second agitator rows circumferentially extend around the cylindrical body once.

9. The cleaner head according to claim 1, wherein the elongate agitator formation comprises a third agitator row that extends around the cylindrical body in a direction from the first edge (L) of the cylindrical body towards the second edge (R) in the first helical direction, the third agitator row extending from a position proximate the first edge (L) towards or beyond the centre (C) and comprising agitators of the second material, and a fourth agitator row that extends around the cylindrical body in a direction from the second edge (R) of the cylindrical body toward the first edge (L) in the second helical direction, the fourth agitator row extending from a position proximate the second edge (R) towards or beyond the centre (C) and comprises agitators of the first material, the third and fourth agitator rows extend axially along the cylindrical body such that they do not overlap with one another.

10. The cleaner head according to claim 9, wherein an axially inner end of the third agitator row and an axially inner end of the fourth agitator row are angularly offset from one another.

11. The cleaner head according to claim 1, wherein the elongate agitator formation is configured such that during use, at every degree of rotation of the cylindrical body, one point of contact with the floor surface is made by agitators of the first material and one point of contact with the floor surface is made by agitators of the second material.

12. A vacuum cleaning appliance comprising the cleaner head according to claim 1.

* * * * *